US005246273A

United States Patent [19]

Rosar

[11] Patent Number: 5,246,273

[45] Date of Patent: Sep. 21, 1993

[54] METHOD AND APPARATUS FOR SOLUTION MINING

[76] Inventor: Edward C. Rosar, 13352 W. Dakota Ave., Lakewood, Colo. 80228

[21] Appl. No.: 699,973

[22] Filed: May 13, 1991

[51] Int. Cl.[5] ..... E21B 43/28; E21C 25/60

[52] U.S. Cl. ..... 299/4; 175/45; 175/67; 299/17

[58] Field of Search ..... 299/4, 5, 6, 17; 175/45, 62, 67, 107

[56] References Cited

U.S. PATENT DOCUMENTS

| | | | |
|---|---|---|---|
| 1,851,565 | 3/1932 | Claytor | 299/6 X |
| 3,155,177 | 11/1964 | Fly | 175/67 |
| 3,311,411 | 3/1967 | Cannon, Sr. et al. | 299/18 |
| 3,347,595 | 10/1967 | Dahms et al. | 299/4 |
| 3,747,696 | 7/1973 | Wenneborg et al. | 175/87 |
| 3,873,156 | 3/1975 | Jacoby | 299/4 |
| 3,941,422 | 3/1976 | Henderson | 299/4 |
| 3,962,080 | 6/1976 | Dulin et al. | 210/59 |
| 3,984,312 | 10/1976 | Dulin et al. | 210/15 |
| 4,401,345 | 8/1983 | Archibald | 175/67 X |
| 4,536,035 | 8/1985 | Huffman et al. | 175/67 X |
| 4,726,710 | 2/1988 | Rosar et al. | 405/129 |
| 4,815,790 | 3/1989 | Rosar et al. | 299/4 |
| 4,946,311 | 8/1990 | Rosar et al. | 405/129 |

FOREIGN PATENT DOCUMENTS

| | | | |
|---|---|---|---|
| 720142 | 3/1980 | U.S.S.R. | 299/4 |
| 876968 | 10/1981 | U.S.S.R. | 299/4 |
| 1317129 | 6/1987 | U.S.S.R. | 299/4 |

OTHER PUBLICATIONS

"Solution Mining of Halite Through Boreholes" Charles Jacoby *SME Mining Engineering Handbook* vol. 2, 1973 pp. 21-49 thru 21-55.

*Primary Examiner*—David J. Bagnell
*Attorney, Agent, or Firm*—Jacques M. Dulin

[57] ABSTRACT

Evaporite mineral solution mining process and apparatus comprising the steps of undercutting a bed or massive deposit by in-air jetting with an aqueous solution followed by solution mining of the mineral above the undercut with monitoring and control to cease the solution mining when the roof rock is adequately exposed to maintain a stable roof and stable pillar support. The resulting cavity exhibits steeply angled, nearly vertical sidewalls, flared upwardly and outwardly only 10° to 15° from the vertical plane normal to the edges of the undercut as compared to 45° typical for morning glory cavities. A first plan vertical production well is drilled with a sump provided substantially adjacent to the floor rock. A second horizontal well is developed up dip to intersect and communicate with the production well. The air jet tool mechanism provides horizontal, slightly upwardly inclined jets (0°-15°) which cut the mineral laterally on both sides of the tool which is gradually withdrawn up dip as the undercut progresses. The tool also includes and EMR ranging system, preferably a radar system, and a MWD unit to transmit data to the surface. This permits undercut width control to develop a substantially rectangular undercut profile. The subsequent controlled solution mining provides a substantially rectangular room throughout the entire horizontal length which provides improved mineral recovery, steeply angled pillar wall profiles controlled roof span and increased dissolution rate. The method and apparatus is applicable to beds having dips from 0°-90° and multiple beds with or without partings.

21 Claims, 7 Drawing Sheets

METHOD AND APPARATUS FOR SOLUTION MINING

FIELD

The invention relates to methods and apparatus for solution mining, and more particularly to improved methods and special apparatus for solution mining of water soluble and slowly soluble evaporite minerals, such as nahcolite, in beds which range from horizontal to vertical dips, involving open-air jet undercutting in a controlled manner followed by dissolution of the bed above the undercut. The undercut jetting system can be used in beds dipping from 0° to 90°, or in massive evaporite deposits such as salt domes. The jets project at an angle, preferably normal, to the direction of advance or withdrawal of the tool and slightly inclined, which results in precise control of the shape of the cavity, greater recovery of mineral, and greater rate of mineral dissolution.

BACKGROUND

A wide variety of minerals are best recovered from their underground deposits by what is called solution mining, a process in which steam, hot water or cool water is injected into the mineral bed in a first well, and a mineral-laden brine is pumped up a second well.

An example of solution mining of nahcolite is shown in U.S. Pat. No. 4,815,790, of which I am one of the co-inventors. That patent shows the use of hot water under special conditions of pressure and temperature to recover a brine of nahcolite, a sodium bicarbonate mineral. In the background of that patent are discussed some of the problems of prior art solution mining techniques, for example the formation of "morning glory" holes which are generally narrow at the base and flare outward at the top in a generally convex upward cross-sectional floor profile. A variety of techniques have been attempted in order to prevent the formation of such types of holes, since they are very wasteful and since they result in a low percentage of mineral recovery from the bed. One of these techniques involves use of an air cushion above the level of the fluid in the cavity to achieve a more or less cylindrical solution cavity.

Solution mining of salt to obtain a saturated brine is known to have been used in France as early as A.D. 858, and is the basis of present technology. Solution mining of salt was first employed in the United States in about 1882, and consisted of drilling a small diameter well down to a layer of salt, pumping freshwater down to dissolve the salt, and pumping the resultant brine to the surface for subsequent evaporation. One of the more modern solution mining techniques is where a first injection well is sunk, and pressurized freshwater is introduced to hydraulically fracture the bedded salt. Once communication with a second, laterally positioned production well is established, the brine is pumped to the surface for treatment.

Roof collapse of the overlying strata and surface subsidence are potential problems associated with solution mining; however, some precautions can be taken to minimize these hazards. One method is to inject air with the water into the salt caverns. The air forms a protective cover between the water and the top of the cavity and thereby reduces the amount of dissolution of the roof.

Several U.S. patents have been devoted to either solution mining or jet cutting. For example, Cannon U.S. Pat. No. 3,311,411 discloses mining of a granular water insoluble (as distinct from a monolithic bedded) phosphate ore by use of a down-well positive displacement pump at the lower end of a vertical conduit sealed in the well. The method depends on inducing lateral flow of the granular ore to the casing by the suction of the pump.

Claytor U.S. Pat. No. 1,851,565 mines oil-bearing sands or sulfur using a heated solution of sodium carbonate projected laterally from a vertical string through a hinged side arm nozzle, the purpose being to fluidize the oil or melt the sulfur. A second, downwardly directed nozzle agitates the area directly below the vertical pipe to provide a sump for the production pipe inlet at the bottom of the string. A lifting arm raises the arm from a vertically downward position (which permits it to be lowered downwell) to a horizontal position. The combination of undercutting plus solution mining is not taught or suggested as Claytor is directed to use of the hinged nozzle to fluidize the entire tar sands or sulfur bed.

Wenneborg U.S. Pat. No. 3,747,696 slurry mines granular water insoluble phosphate ore by use of a vertical drill string having a directionally indexable but non-rotable section bearing a sideward directed jet, the opening and closing of which can be controlled by hydraulic pressure acting on a valve/lever assembly. The method shown in Wenneborg's FIG. 2 apparently top cuts, as compared to undercutting, and the resulting cylindrical cavern has a floor sloping downward to the center. Solution mining is not taught.

Fly U.S. Pat. No. 3,155,177 is directed to a vertical, hydraulically powered cutter and pump which is rotated from the surface and has horizontally directed cutting jets, which are movable up or down or controllably rotated, with a hydraulic jet pump located therebelow in a submerged sump. Opposed side wall jets are used to cancel reaction thrust to insure the drill string hangs vertically in the well. Liquid hydrocarbons are used as the hydraulic cutting fluid to under-ream tar sands. The side wall cutters are said to be useable without rotation to form pairs of lateral trenches. A series of vertical holes would permit forming an interconnected tunnel with adjacent trench floors forming a series of interconnected V's. Solution mining is not shown and it is not clear whether the cutting proceeds top down or bottom up. In any event, the sloping bottoms are not indicative of undercutting.

The mining and processing of rock salt can bring about a degree of disruption to local environments and existing ecological systems. A major environmental concern in solution mining of salt is land subsidence. As the salt is dissolved, some roof collapse may occur, causing sections of the surface to partially or totally fill the cavity. Subsidence is unpredictable, and once the process begins, it must be allowed to finish and reach equilibrium.

The world resources of salt are virtually unlimited. The identified salt resources of the United States alone are estimated as $61\times10^{12}$ short tons (st). World salt production estimates by the Bureau of Mines rank the US first with 34 Mt (37.5 million st), followed by China, 18 Mt (20 million st); the Soviet Union, 16 Mt (18 million st); the Federal Republic of Germany, 13.6 Mt (15 million st); India, 11.2 Mt (12.4 million st); and Canada, 9 Mt (10 million st). Other major producers are France, the United Kingdom, Australia, Poland, and Mexico. Total world salt production in 1988 was 179 Mt (197 million st).

The production of potash in the United States is declining as lower ore grades are being mined, reserves are being depleted, and new economic deposits have yet to be discovered. Mining lower ore grades results in higher costs per ton of product at the mine and leads to a small marketing area when transportation costs are added. As a result of this decline, the United States is becoming increasingly dependent upon potash imports from Canada.

Estimated domestic potash resources total about 6 billion Mt $K_2O$ equivalent. Most of this lies between 1,800 and 3,000 meters deep, in a 3,100 square kilometer area of Montana/North Dakota as an extension of the Williston Basin Deposits in Saskatchewan. The Paradox Basin in Utah contains approximately 2 billion Mt $K_2O$, mostly at depths more than 1,200 meters. An unknown quantity of potash resources lie about 2,100 meters deep under central Michigan. These resources can be extracted only by solution-mining techniques because of the bed depth. Operation of a solution mine in Saskatchewan for several years has demonstrated the commercial viability of solution mining under certain conditions. Extensive potash occurrences in the form of polyhalite in west Texas and New Mexico are not included because current technology does not permit economic recovery of this mineral.

For example, the Cane Creek Syncline Mine (Texas Gulf mine) near Moab, Utah, was converted to a solution mine after 6 years of underground mining because much folding was encountered, along with methane gas. The single solution mine at Belle Plaine (the Kalium Mine) in Saskatchewan, Canada, was originally developed as a solution mine because the ore zone was below the reasonable depth (3,500 feet) for underground mining in a sedimentary sequence.

In Michigan, Dow Chemical Co. core-sampled bedded sylvinite near Midland, and evidence was obtained that potash may underlie some 33,700 square kilometers of the Michigan Basin. The potash occurs in a stratigraphic unit known as the A-1 Salt of the Salina Group, of The Silurian Period. At Midland, the salt layer containing the potash is 120 meters thick and is at a depth of about 2,440 meters. Kalium Chemicals of PPG Industries, Inc., is strongly considering solution mining potash west of Midland, between Big Rapids and Reed City. Limited released data indicates the enriched zones/beds of potash within the A-1 salt vary in thickness from a few centimeters to approximately ten meters or more and with ore grades varying from 2% to 64% KCl.

While solution mining of sylvinite may bring about the reclassification of the Michigan deposit from the resource to the reserve category, even so the United States is expected to continue to be a net importer of potash.

Sylvinite ore can be mined by injecting water through a well and withdrawing a NaCl-KCl saturated solution through another well, or by using concentric pipes in a single well. To control the shape of the solution cavity, the solution can be blanketed by a layer of oil or gas at the roof. Solution mining can be considered if the beds are very irregular or if they are at depths greater than 1,100 meters where halite creep becomes a problem, but the ore zones have to be thicker than about 15 meters or included for solution mining to work under the current practices.

World potash demand increased in 1987–88 for the second year in a row, reaching a record level of 27.6 Mt (30 million st) $K_2O$. This was an increase of 5.2% over the 1986–87 demand of 26 Mt (29 million st). The grown in consumption was the net result of a 22.7% increase in demand in developing countries (1.2 Mt or 1.3 million st). Total world potash production increased by 1.6 Mt (1.8 million st) $K_2O$ in 1987–88 to 30.4 Mt (33.5 million st) in response to the higher market demand. World potash demand is expected to grow 1.5% to 2% per year for the next decade as developing countries strive to increase crop production to feed their growing populations and reduce the cost of imported foodstuffs. The FAO/World Bank/UNIDO Industry Working Group on Fertilizers forecasts an increase in potash consumption from 27.6 Mt (30 million st) $K_2O$ in 1987/88 up to 31.7 Mt (35 million st) in 1997/98. Production in the U.S. declined by 200 kt (220,000 st), reflecting a reduction in ore grade at some of the older mines. It is estimated that in 1989 domestic mine production will be 1.5 million tons and that the U.S. apparent consumption will be 5.6 million tons.

There are over 60 identified natural sodium carbonate deposits in the world, the largest of which is the trona deposit in southwest Wyoming. The Wilkins Peak Member in the Green River Formation contains 42 beds of trona, 25 of which have a thickness of 3 feet or more. Eleven of these beds exceed 6 feet in thickness and underlie a surface area of more than 1,100 square miles.

Underground mining of Wyoming trona is similar to coal mining, except that trona is a harder mineral than coal. The present Wyoming soda ash producers use room-and-pillar, longwall, shortwall, and solution mining techniques individually or in combination.

FMC has pioneered the use of solution mining to dissolve and recover deeply buried trona. Using an array of injection and recovery wells, a solvent, presumably dilute sodium or calcium hydroxide, is introduced under pressure to dissolve the underlying trona. This technique, although proven, is still in the experimental phase.

Two potential sources of soda ash, nahcolite (sodium bicarbonate) and dawsonite (sodium-aluminum carbonate), are associated with oil shale in the Piceance Creek Basin of northwest Colorado. Identified resources of 32 billion tons of nahcolite and 19 billion tons of dawsonite, equivalent to 20 billion tons and 7 billion tons, respectively, of sodium bicarbonate resources, would be available as a byproduct of oil shale processing or as a single mineral extraction.

In 1988, domestic soda ash production reached a record 8.7 Mt (9.6 million st), an increase of 8% over 1987. Export sales also set a record with total shipments exceeding 2.2 Mt (2.4 million st). These increases were attributed to a rise in domestic and foreign demand for consumer products that use soda ash. A cyclic opportunity also presented itself to sell soda ash to certain crossover markets that traditionally use caustic soda, such as pulp and paper, chemicals, and alumina refining. Apparent consumption of soda ash in the United States rose 7% to 6.7 Mt (7.4 million st).

However, solution mining works best in thickly horizontal beds. One of the problems in mining some types of evaporite minerals, such as, for example, nahcolite, is that the beds may be relatively thin, on the order of a few inches to a few feet. Only occasionally are there beds that range thicker than 15-20 feet. Usually, the thicker the bed the lower the grade of mineral, as it is interspersed with other types of rock deposits, such as in the case of nahcolitic kerogen-bearing rocks. Upon the application of steam, the kerogen rock releases oil which either leaches out or forms an oily froth which interferes with production or quality of mineral sought to be dissolved by the mining solution.

Further, mining of these types of minerals is often hindered by the fact that they may lie in relatively soft overbearing strata. The soluble minerals themselves may actually be somewhat stronger than the softer overlying rocks, which can result in pillars punching holes through the roof, roof collapse, and the like unless the caverns are kept small or morning glory hole shapes (in the case of solution mining) are avoided. All of these necessitate mining smaller cavities with larger support pillars. In the case of room and pillar mining, the use of extensive roof bolting or other shoring techniques normally would be required. Further it is not economically feasible in most situations to room and pillar mine thin beds, even in the case of highly valuable nahcolite mineral.

Nahcolite is an extremely valuable mineral, being used as an air pollution control sorbent. The sodium bicarbonate content reacts with $SO_x$ and $NO_x$ in flue gases of power plants to remove these pollutants. The resulting sodium sulfate wastes may be safely disposed by a variety of techniques such as shown in U.S. Pat. Nos.: 4,726,710 (Co-Disposal I); 4,946,311 (Co-Disposal II); 3,962,080 (Sinterna process); and 3,984,312 (Fersona process).

Accordingly, there is a need to improve solution mining productivity, particularly for evaporites in thin beds, in steeply dipping beds, or in massive deposits. Of particular need is to recover nahcolite present in thin beds in the Piceance Creek Basin in Northwestern Colorado. Being able to control the shape of the cavities, and to solution mine thin, multiple high-grade beds of purity in excess of 60-85% will help make this mineral more available at a lower cost, and thus help solve the nation's air pollution problems, particularly the $SO_x$-g/$NO_x$ emissions from power and industrial plants.

THE INVENTION

OBJECTS

It is among the objects of this invention to provide an improved solution mining process for water soluble minerals such as nahcolite, trona, and sylvite which permits better control of the shape of the cavities, both on the vertical and horizontal plane.

It is another object to provide method and apparatus for solution mining of nahcolite and other water or steam soluble evaporite minerals that permits production of relatively rectangular solution mining cavities that do not exhibit vertical flaring typical of morning glory holes and/or barbell shape development, thus resulting in improved mineral recovery at lower costs.

It is another object of this invention to provide a method and apparatus for controlled undercutting of evaporite minerals preparatory to circulatory solution mining.

It is another object of this invention to provide a method and apparatus for controlled undercutting of evaporite minerals which results in a greater dissolution rate of the said mineral.

It is another object of this invention to provide an open-air high pressure water jet undercutting method and apparatus that can be applied to evaporite minerals in beds having dips ranging from 0° to 90°, and to massive deposits thereof.

It is another object of this invention to provide a jetting apparatus which permits introduction of high pressure barren solution at an angle preferably transverse to the direction of introduction or withdrawal of the jetting tool and inclined in declination in the plane of or across the strike of the mineral bed, and to measure and control the lateral extent on either side of the jetting tool of the cavity formation by the jets of barren solution.

Still further other objects will be evident from the drawings and detailed descriptions which follow.

DRAWINGS

The process and apparatus of this invention are illustrated in the drawings in which.

Figure 4:
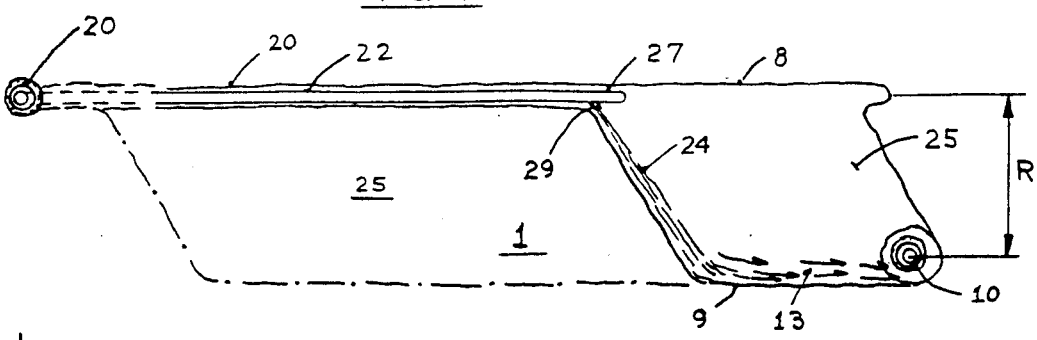
FIG. 4 shows in top plan view the undercut process of the invention using a single jet to cut only to one side of the horizontal well.
Figure 5A:
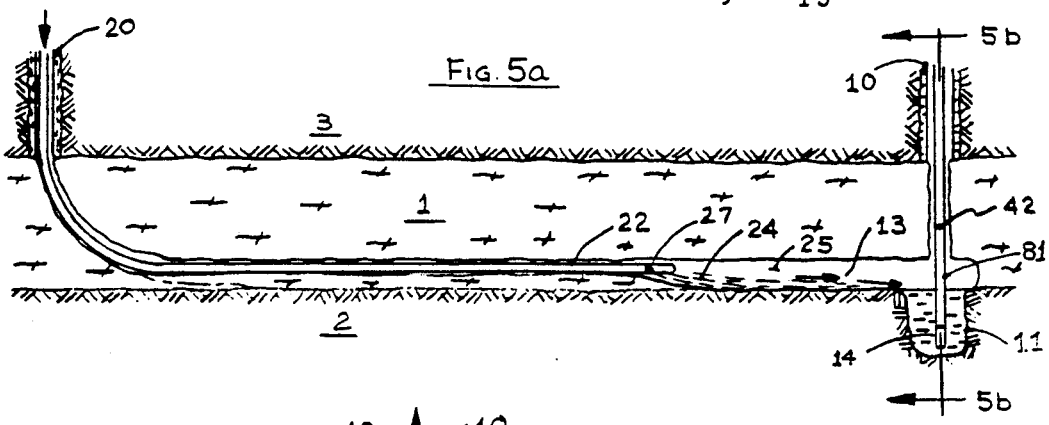
Figure 5B:
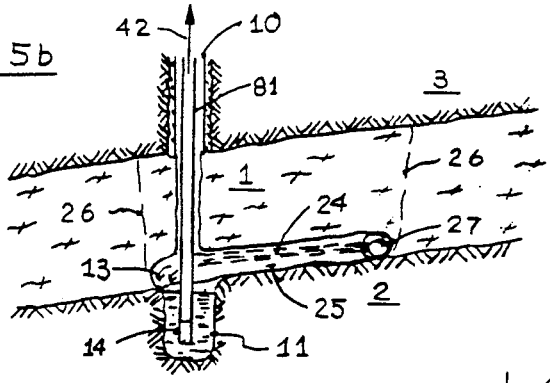

FIGS. 5*a* and 5*b* show side and end elevation views respectively, the single side operation of FIG. 4, FIG. 5*b* being taken along line 5*b*–5*b* of FIG. 5*a;*

Figure 6A:
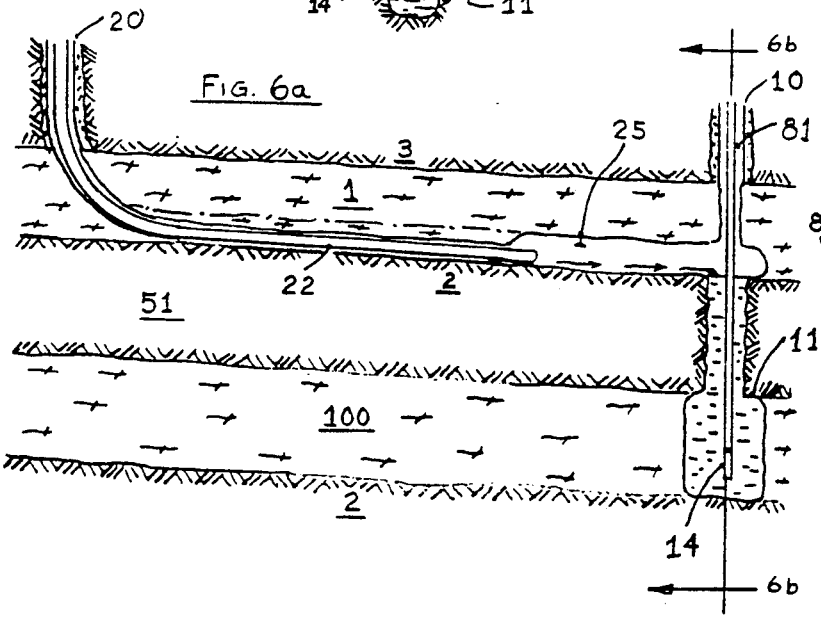
Figure 6B:
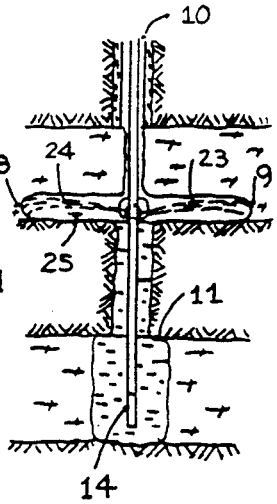
Figure 7A:
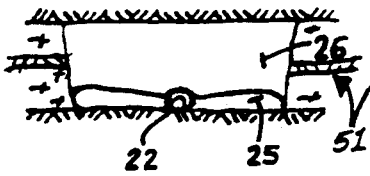
Figure 7B:
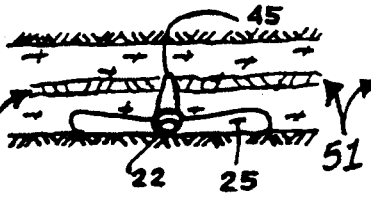
Figure 7C:
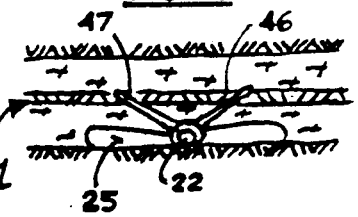
Figure 8A:
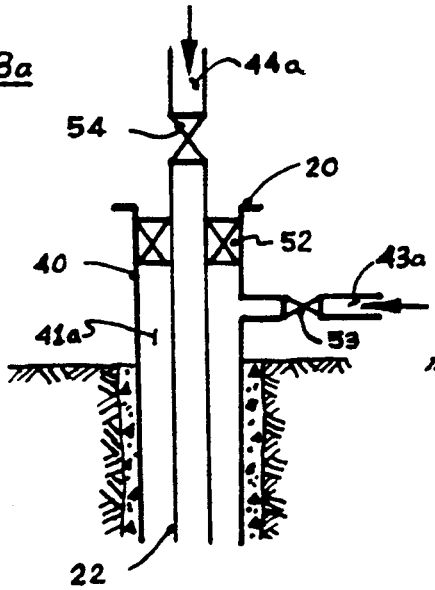
Figure 8B:
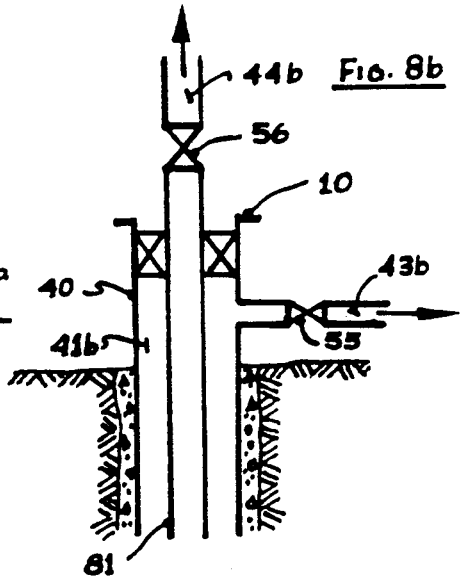
Figure 9A:
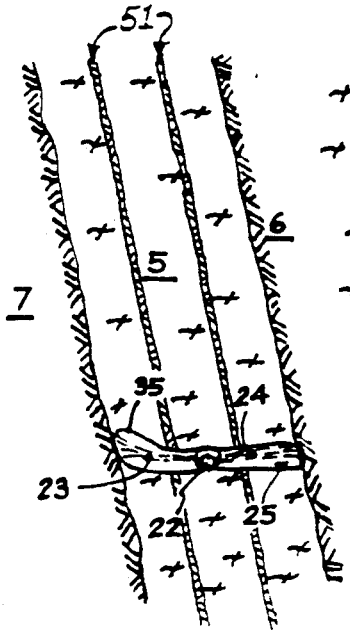
Figure 9B:
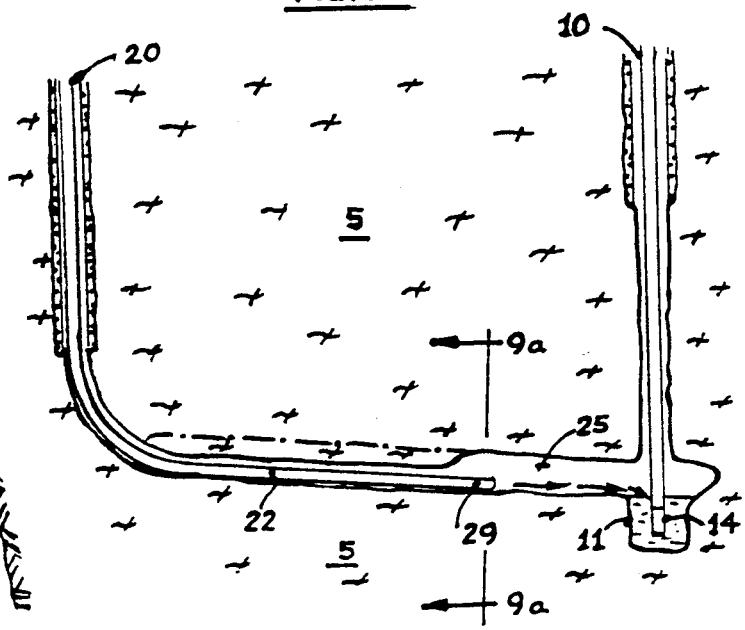
Figure 10:
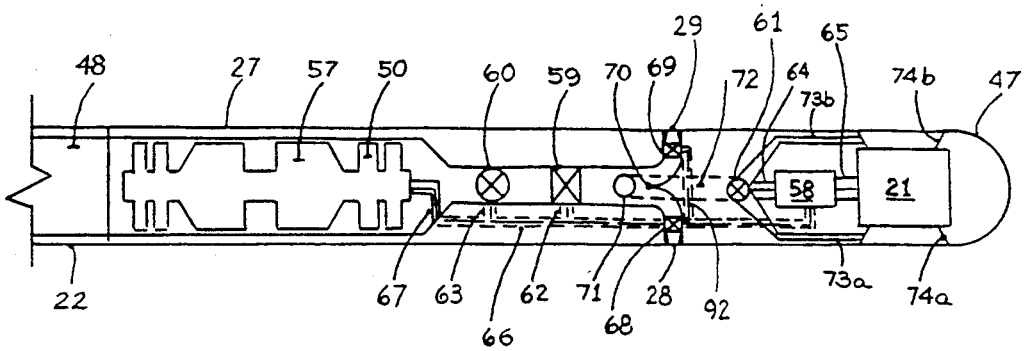
Figure 11A:
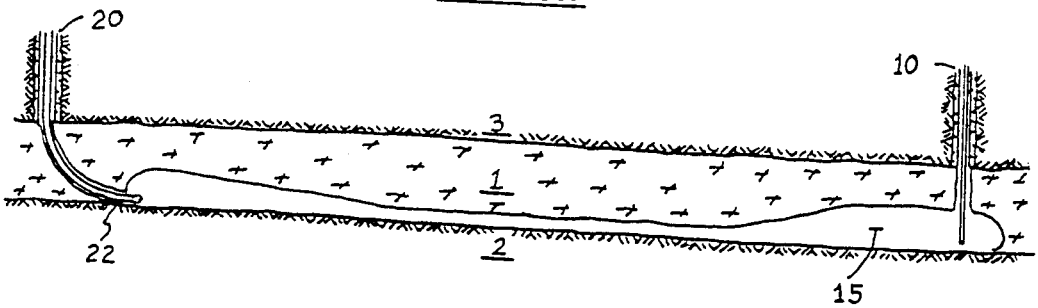
Figure 11B:
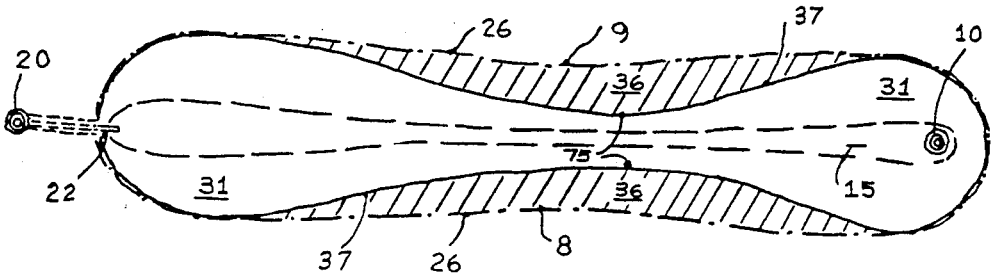
Figure 12A:
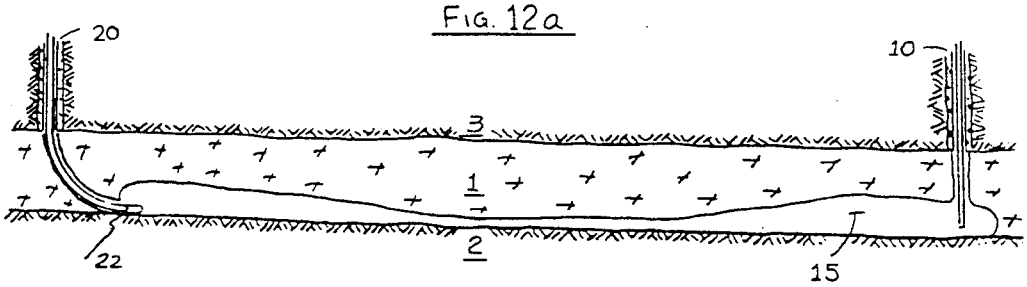
Figure 12B:
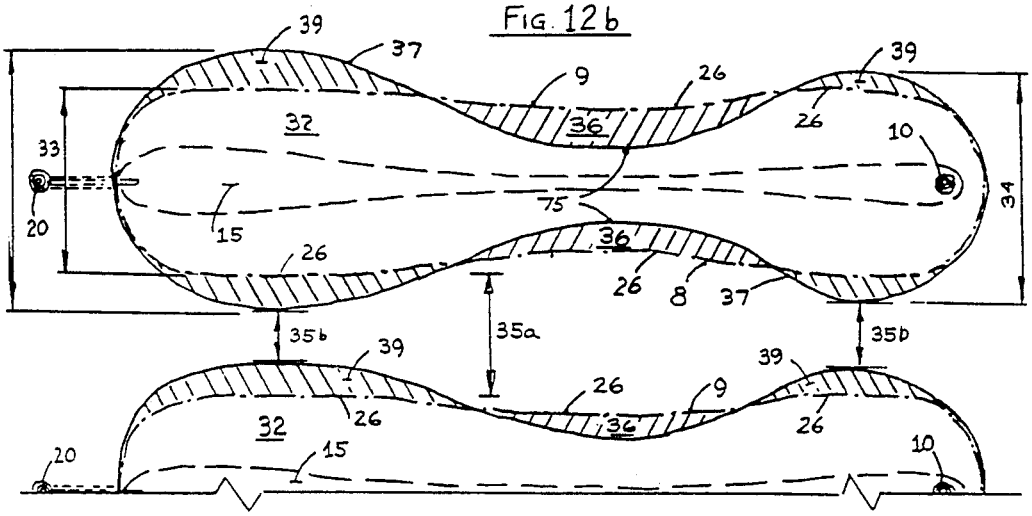
Figure 13A:
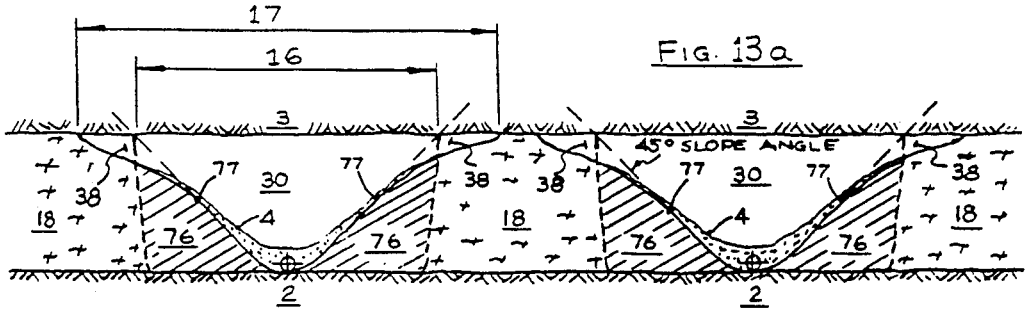
Figure 14A:
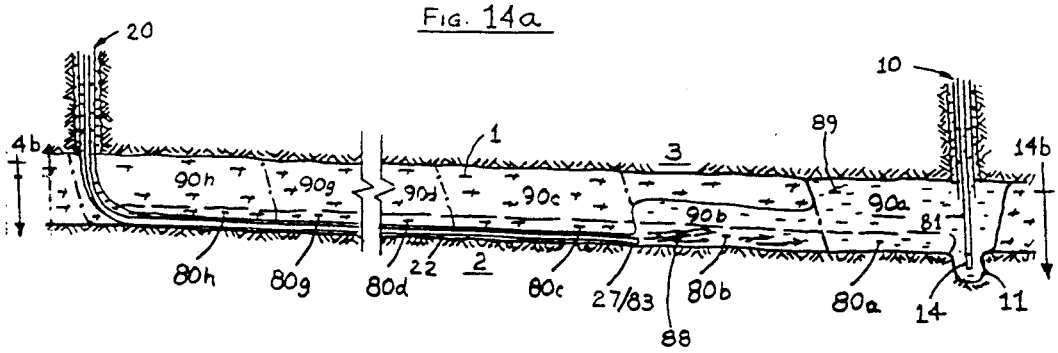
Figure 14B:
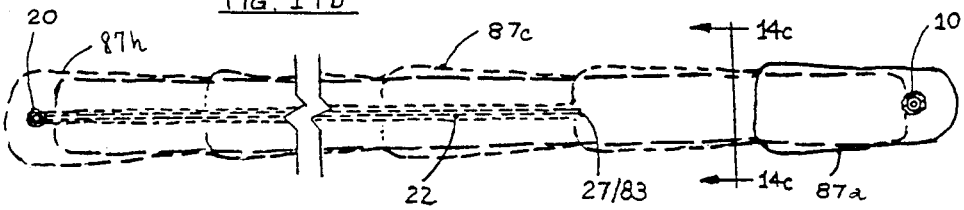
Figure 15A:
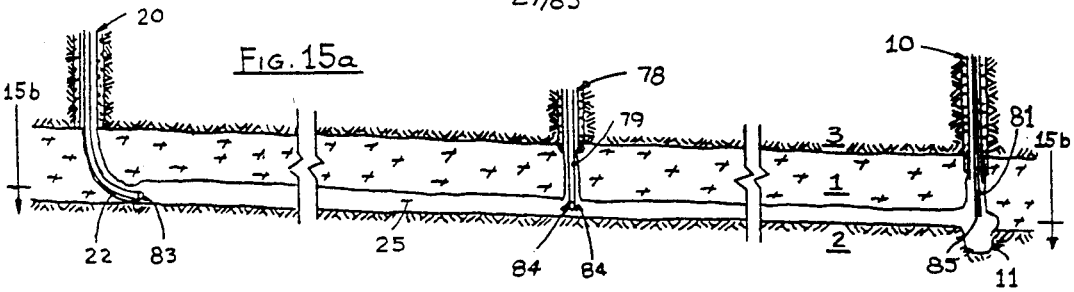
Figure 15B:
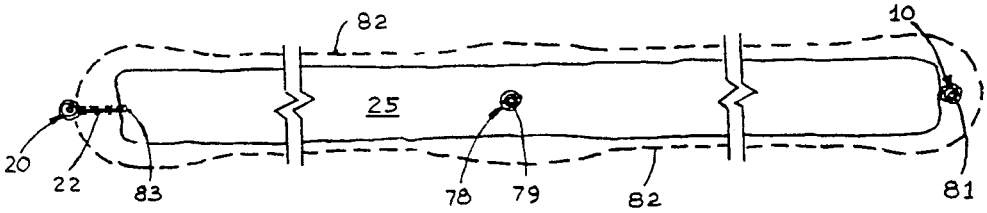
Figure 15C:
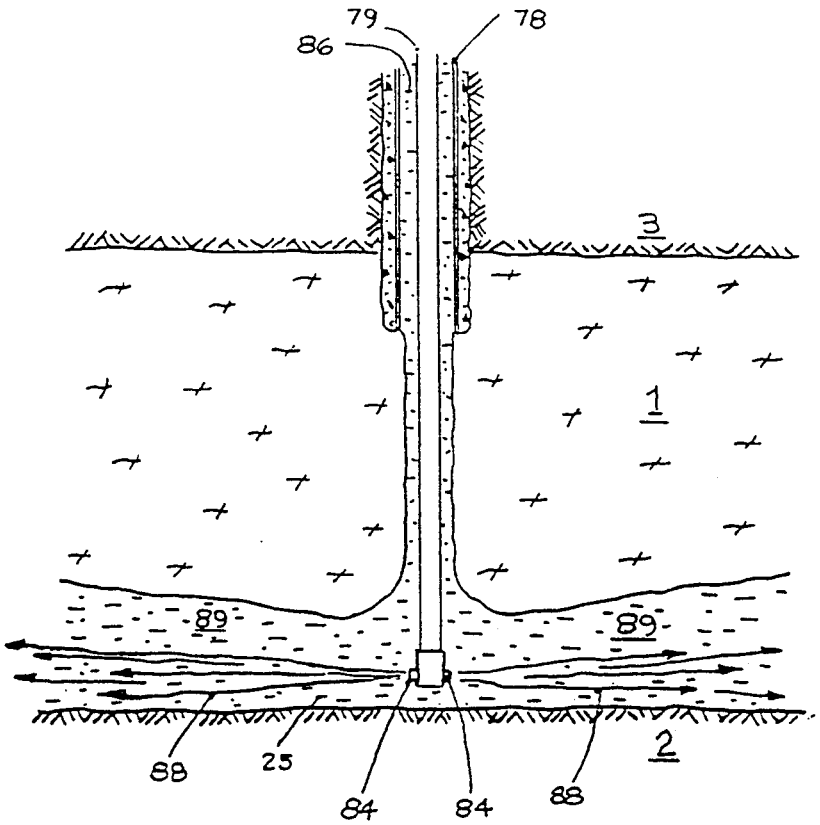

FIGS. 6*a* and 6*b* show in side and end elevation views, respectively, the undercut process in operation for a multi-bed deposit;

FIGS. 7*a*–7*c* are a series of end elevation views of various undercut profiles produced by the process of this invention:

FIGS. 8*a* and 8*b* are side sectional views, in schematic, of well head valving operations during operation of the process of this invention;

FIGS. 9*a* and 9*b* are vertical sections of operation in a steeply dipping bed;

FIG. 10 is a longitudinal sectional view, partly in schematic of the horizontal jet/power/monitoring tool of this invention;

FIGS. 11*a* and 11*b* are side elevation and plan views respectively comparing the in-air jet undercut process of this invention with conventional oil/air pad solution under cutting method and highlights loss of reserves in a horizontal bed due to a barbell shape development;

FIGS. 12*a* and 12*b* are side elevation and plan views respectively comparing the in-air jet undercut process of this invention with uncontrolled conventional oil/air pad solution under cutting method and highlights unstable roof formation in a horizontal bed as well as an unstable pillar between adjacent cavities;

FIGS. 13*a* and 3*b* show in side section view the shape of solution mined cavities of this invention (FIG. 13*b*) as compared to conventional methods FIG. 13*a*) using a single horizontal hole intercepting a vertical or horizontal hole or vertical hydrofracture;

FIGS. 14*a* and 14*b* are side elevation, plan, and end elevation views for staged development of long cavities; and FIGS. 15*a* and 15*b* are side elevation and plan views for a three hole system solution mining development of long cavities; and FIG. 15*c* is a side view of a jet nozzle apparatus attached to the injection string in the mid-cavity hole.

SUMMARY

Method and apparatus for solution mining of water or steam soluble evaporite minerals, particularly evaporite minerals present in one or more thin, laterally extensive or lenticular beds, which beds may range in dip from 0° (horizontal) to 90° (vertical), or which may be present in massive deposits, usually as salt domes. In its most general terms, the process involves open air jetting of an undercut in a precise, controlled pattern, followed by removal of the mineral of the bed above the undercut by one or more solution mining techniques including conventional solution mining. Generally rectangular cavities (as seen in plan view) can be produced with precise control of the size, location and spacing of such support pillars as may be needed to prevent cavity roof collapse, surface subsidence, and disruption of both surface and subsurface ecology and geology, including alteration of watersheds, stream courses and both wildlife and plant habitats. Further, the process and apparatus of this invention are applicable to lower grade, monolithic bedded ores (mineral deposits) at far greater depths than can economically be mined by conventional solution mining or room and pillar techniques, and to folded beds, beds exhibiting halite creep, and beds having excessive content of methane gas which ordinarily necessitate mine closure.

This process is applicable to solution mining of soluble and slowly soluble evaporite minerals. Typical minerals include, but are not necessarily restricted to the following: Trona ($Na_2CO_3.NaHCO_3.2H_2O$) and Nahcolite ($NaHCO_3$), which produce soda ash ($Na_2CO_3$) and Sodium Bicarbonate ($NaHCO_3$), respectively; Halite (NaCl) which produces all purpose rock salt; Mirabilite ($Na_2SO_4.10H_2O$) and Thenardite ($Na_2SO_4$) to produce Sodium Sulfate ($Na_2SO_4$); and the Potassium minerals Sylvite (KCl), Carnalite ($KCl.MgCl_2.6H_2O$), Sylvinite (KCl+NaCl), Kainite ($KCl.MgSO_4.3H_2O$), Nitre ($KNO_3$), Langbeinite ($2MgSO_4.K_2SO_4$), Polyhalite ($K_2MgSO_4.2CaSO_4.2H_2O$), and Schoenite ($K_2SO_4.MgSO_4.6H_2O$) to produce Muriate (KCl), Langbeinite ($2MgSO_4.K_2SO_4$), Sulfate ($K_2SO_4$), and Nitrate ($KNO_3$); and the borate mineral borax ($Na_2B_4O_7.10H_2O$) to produce borax decahydrate ($Na_2B_4O_7.10H_2O$), borax pentahydrate ($Na_2B_4O_7.5H_2O$), borax anhydrous ($Na_2B_4O_7$), and boric acid ($H_3BO_3$). Of particular interest, to which the examples herein are directed, is Nahcolite, a naturally occurring mineral form of sodium bicarbonate situate in the Piceance Creek Basin in Northwestern Colorado.

The undercutting procedure of the method of this invention comprises the steps of: Drilling a pair of spaced bore holes; establishing communication between the bore holes; introducing an "open air" jetting tool, which in the case of horizontal beds is introduced by causing the bore hole to curve horizontally in the region of the bed to permit the jetting tool to be introduced within the bed; advancing the jetting tool to the second bore hole (the production bore hole or well); withdrawing the jetting tool while jetting laterally, i.e. transversely to the direction of withdrawal of the jetting tool on one or both sides of the tool; and pumping the pregnant solution out the production well while maintaining the desired pressure and temperature within the developing cavity. There is a slight dip or incline toward the production well so that undercut fines can be transported to the production well by down-slope fluid flow in the form of solids and in solution.

The open air jetting tool for the horizontal operation is characterized by being a tubular probe capped at its axial forward end, and having one or more (preferably two) hole(s) or nozzle(s) inclined from 0°–15° above the horizontal along the mid-line of one or more (preferably both) sides to permit development of non-rotating lateral jets. The nozzles may be angled from 0° to 60° forward of transverse to the axial centerline, i.e. 0° is transverse to the centerline to direct the jets laterally outward.

The lateral extent of the undercut development depends on a number of factors, including the cutting solution temperature, the nature of the deposit, the inclination and direction of the jets, the rate of barren solution and gas (air, $CO_2$ or inert gas) flow out the jets, and the pressure, all of which determine the fluid force on the sides of the undercut cavity as well as the ultimate lateral reach of the cutting jets. The pressure, temperature, air (or gas) and mineral content of the barren solution also has a bearing on the rate and shape of undercut development.

Another important aspect of this invention is the use of electromagnetic radiation (EMR), such as radar, infra red or microwave emissions, to measure and monitor the undercut depth and or shape, and thereafter to manage the cutting rate, depth and shape of the undercut cavity by control of the parameters above-mentioned, e.g., the fluid (solution/gas) mix temperature, pressure, and flow rate, and the sump pump-out rate, jet inclination, jet angle, string withdrawal rate, and the like. The jetting tool includes a power source, preferably a turbine and rechargeable battery pack and an MWD unit to transmit ranging information and operating commands to and from the surface.

Once the undercut has been produced, and preferably measured and mapped, then production solution mining can be carried out by filling the undercut cavity with the appropriate barren solution at operating conditions and circulating it to enlarge the cavity vertically. For example, I prefer the Nahcolite to employ the solution mining process of U.S. Pat. No. 4,815,790. (Rosar/Day Solution Mining Patent). The measuring and mapping involved in this invention during undercutting has an important corollary at this step. The initial solution mining will develop an arced cavity whose vertex will intercept the bed roof rock. With proper monitoring and control the dissolution of the arc will proceed upwardly and laterally to form a flat plane along the roof rock and steeply angled cavity walls, which flare outwardly at an angle ranging from only about 10° to 15° from the apex located at the intersection of the vertical plane normal to the bottom outside edges of the undercut. This results in a stable roof and pillars. This dissolution development can be controlled by the process of this invention by the combination of monitoring by EMR, or sonar, along with production well mass removal measurements of the mining progress and utilizing an inert blanket, such as air or oil.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, 5including what I presently believe is the best mode of carrying out the invention.

As shown in the Figures, basically, the system uses a high pressure jet of water (solution) in air to form an undercut. The water drains down the floor of the undercut to a central sump. The downward draining is attained by using the geologic formational dip or artificially cutting a slope with the jets. This system is illustrated in detail below for undercuts derived from vertical and horizontal drillholes.

Figure 1:
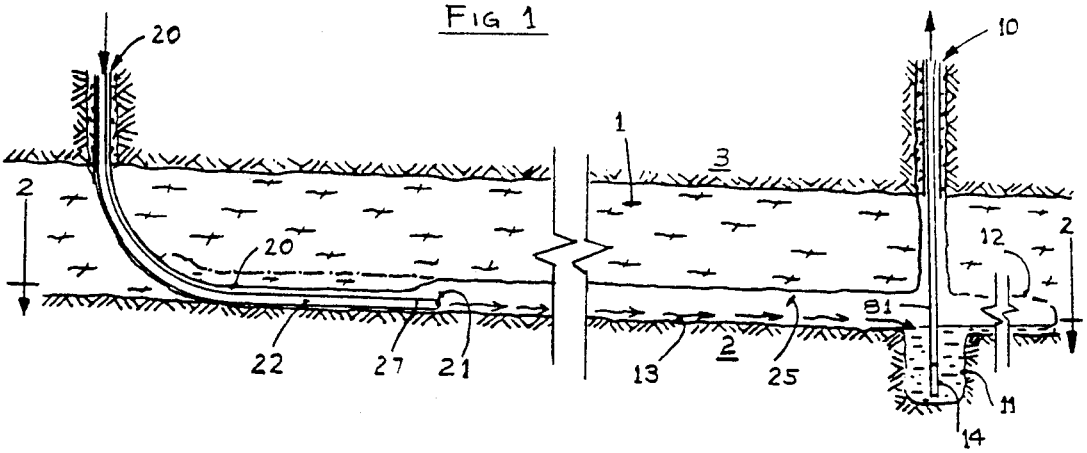
FIG. 1 is a side elevation view of undercut operations of this invention in an essentially horizontal evaporite bed.
Figure 2:
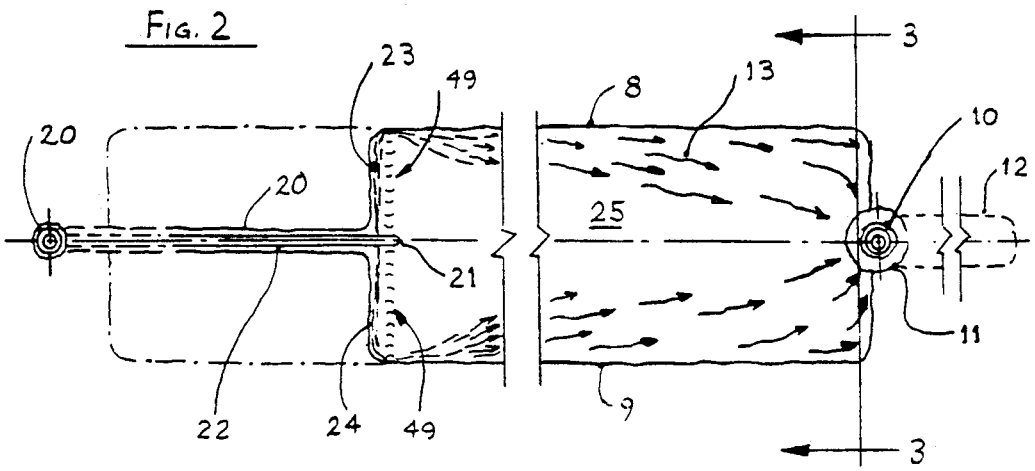
FIG. 2 is a plan view of the undercut of FIG. 1 taken along line 2—2 of FIG. 1.
Figure 3:
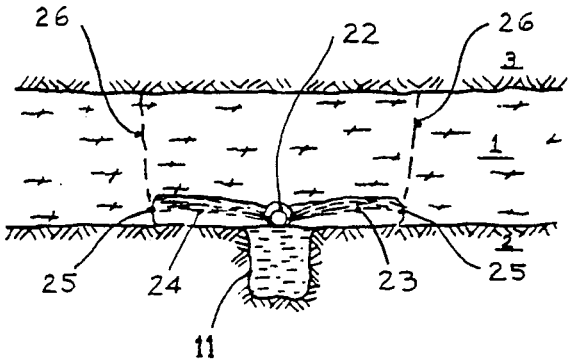
FIG. 3 is an end elevation view of the undercut taken along line 3—3 of FIG. 2 at the sump of the production well showing the advantage of steeply angled wall development during subsequent solution mining as compared to morning glory hole and barbell shape development by conventional techniques.

Referring now to FIGS. 1-3, these figures show operation in a horizontal to gently dipping evaporite bed, e.g. a saline mineral bed 1 such as Nahcolite dipping 1.5°-3.0° to the NE, employing a two-well configuration, a first vertical production well 10, and a second horizontal undercut well 20, adjacent the base (floor 2) of the bed 1, with the production well 10 being downdip with respect to the horizontal well 20. Preferably a sump 11 associated With vertical well 10 is formed in the floor rock 2 by reaming. The horizontal well is drilled horizontally by conventional techniques to the vertical well, or 25' to 50' past the vertical hole to form an optional sump 12 by jetting and dissolution (see below).

A radar unit 21 is located at the end of the horizontal jet/pipe string 22. It can be powered by a battery pack, an internal hydro turbine generator, or via a DOT line. Radar measurements can be transmitted to surface via DOT (Directional Orientation Tool), MWD, (Measurement While Drilling), or similar systems.

Adjacent to the radar unit and on the up-hole side, jets 23, 24 shoot out water (solution) streams at right angles to the center line of pipe string 22 and into the open air formed cavity. The jets are held in a horizontal plane across the strike of the dip slope by using a gravity counterweight rotating device, or employing MWD, DOT or other measuring tool adjustment systems.

The jet stream Water (solution) and eroded solids 13 flow away from the cavity cut 25 and down dip to well 10. The solution flows into the sump 11 while the larger eroded undissolved particles settle on the uneven dip slope. The return water (solution) and fine particles can be pumped via submersible pump, air jet pumps or pressurized gas lift means 14. When hot water is introduced into the sump 11, then the suspended fines will be dissolved and only a solution will be pumped to surface.

FIG. 1 shows the vertically thin slice nature of the undercut cavity 25, while FIG. 2 shows the lateral extent formed by opposed jets 23, 24. Radar pulses 49 emanating from the tool tip radar unit 21 mounted on the horizontal string 22 continuously monitor the cut width progress. As the string is retracted up-dip the undercut assumes the generally rectangular shape shown in FIG. 2.

FIG. 3 shows the transverse section view through the cut. Also it compares the steeply angled walls 26 (in phantom) formed during subsequent solution mining as vertical extensions of the side walls 25 of the cut. For better control of cavity configuration during subsequent solution mining, the cavity length should not be exceeded by a range of 4 to 6 times the width of the undercut 25. During solution mining, wells 10 and 20 may be alternated periodically as injection and production wells, with a buoyant barren solution jet stream directed from the injection well to the production well. This procedure reduces the necking down or barbell cavity configuration as a result of jetting less saturation solution to the cavity mid-point. An inert blanket, such as air or oil can be used for additional dissolution control.

FIGS. 4 and 5 describe the undercut procedures for cutting only on one side of the horizontal drill hole 20. In this case a sump 11 is reamed or dissolved out below the desired level of the undercut which is generally coordinate with the bottom of the bed 1 and its juncture with floor rock 2.

The jet mechanism 27 is lowered to the undercut depth and passed horizontally until it is in position so the undercut will intersect the production well. Note in FIG. 4 that the horizontal axis of the string 22 is laterally offset from the vertical axis of the production well 10 by the distance R, which is within reach of the jet 24 issuing from nozzle 29. The initial connection is made with a submerged buoyant jet and the resultant solution is discharged to surface via the annulus of well 20 until a connection is made with well 10. Upon completion of this connection operation, open air jetting commences. A single jet 24 is angled forward from 15°-60°, preferably 15°-45°, and is generally horizontal, so that the jet stream 24, which is dropping due to gravity, follows the incline (dip) of the bed. This is best seen in FIG. 5*b*. The water (solution) 13 and small amounts of very fine cuttings flow on the bottom of the cut towards the sump 11. Most of the fine cuttings are dissolved in the sump. The resulting undercut cavity 25 is shown in the three views of FIGS. 4, 5*a* and 5*b*. The resulting solution mined cavity profile 26 is shown in dashed lines in FIG. 5*b*.

As above, the radar measures the distance of the undercut. An Eastman-Christensen modified DOT or a Schlumberger modified MWD II system may be employed to relay the radar measurements to the surface, as well as the orientation of the jet nozzles. Other conventional data relay systems may also be used.

The return water (solution/fines) 42 in string 81 is pumped back to the surface via high pressure air/$CO_2$ entrained in the jet stream, by a jet air lift, or submersible pump (not shown).

After the undercut is complete, out to the desired width 9, the solution mining operation may be commenced as before. It will result in an essentially straight walled rectangular cavity 26 extending up to the roof rock 3.

FIGS. 6*a* and 6*b* shows operation in a multi-bed deposit. Two beds 1 and 100 are separated by an intermediate host rock or other mineral layer 51. The down dip vertical well 10 is developed through to the lower of the beds (there may be more than two beds separated by rock stratum 51) wherein sump 11 is bored out so that it communicates with the uppermost bed 1 as shown. The horizontal well 20 is developed (as described above) into the upper bed 1 which is then undercut as before by jets 23, 24 (see FIG. 6*a*) forming undercut slice-like cavity 25 to the desired width 8, 9. The string 22 is withdrawn slowly as the undercut is being formed, after which the upper bed is solution mined. Then the next lower bed is processed the same way, and so on down to the lowest bed. Or, all beds can be undercut and all solution mined simultaneously via communication between beds.

FIGS. 7a–7c show various profiles of the undercut. FIG. 7a shows the undercut slice 25 and resultant volume removal 26 by solution mining. FIG. 7b shows a vertical fin 45 can be developed by an additional vertical jet. FIG. 7c shows cuts 46, 47 at 30° in addition to horizontal cut 25, also produced by additional jets.

FIGS. 8a and 8b show valving operations which may be employed when removing plugged jetting fluid and fines. Since jetting takes place "in-air", i.e. in the gas-filled cavity formed by the jets and not in a submerged condition, the pump 14 in sump 11 (see FIGS. 1, 5a, 5b, 6a and 6b for example) will be operated more or less continuously to maintain a minimum of fluid 13 on the floor 2. But minimum fluid may result in build up of fines in certain areas (such as floor roughness, ridges or hollows) that in turn dams fluid, thus slowing or preventing fluid/fines from flowing to the sump and filling the undercut behind the obstruction with jetting fluid. Once the blockage occurs, pressure from the jet system 22, 27, 28, 29 can be used to force an opening in the obstruction. Referring to FIG. 8a, if packer seal 52 is not employed, then the breakthrough pressure will equal the hydrostatic head when the annulus 41a of the casing 40 is backfilled with water (jetting fluid). If a packing seal 52 is employed and the compressed air valve 53 is closed, the pressure in the jetting system can be increased to force an opening in the fines dam obstruction. This pressure should not exceed the formation fracture pressure because undercut cavity formation may be distorted or lost.

If the breakthrough pressure needs to exceed the hydrostatic head, especially in shallow wells, then the jetting fluid inlet valve 54 is closed, the compressed air inlet valve 53 is opened, and either air and/or fluid is introduced into the casing. Referring to FIG. 8b, the jetting fluid/fines outlet valve 56 is closed and the compressed air outlet valve 55 is opened to allow breakthrough air and/or fluid to escape. Where an air jet pump or a pressure gas lift is installed at the bottom of string 81, valve 56 may be left open and valve 55 may be shut or left open.

FIGS. 9a and 9b show the undercutting system of this invention applied to a steeply dipping bed 5 between hanging wall 6 and footwall 7, FIG. 9a being a transverse section view and FIG. 9b being a vertical section along the strike of the bed. Note the horizontal well dips to the right (as shown in FIG. 9b). As best seen in FIG. 9a, flare 35 may develop in undercut cavity 25, defined as upward development of the cavity along the hanging or foot wall. Flare can be minimized or eliminated by differential control of pressure in the jets, i.e. the pressure feeding jet orifice 28 (forming jet 23) can be more or less than that to orifice 29 (forming jet 24) by separate feeds to the jets, or by orifice restrictors (not shown).

FIG. 10 shows in axial section view, partly in schematic, the jet/power/monitoring tool 27 mounted at the end of the horizontal pipe string 22 which terminates in a rounded nose tip member 47. Jetting fluid (e.g., water and air) flowing through bore 48 passes through the MWD package 57 and thence through the integrated hydroelectric turbine generator section 50 which powers the MWD package 57, radar unit 21 and solenoids 59, 60, and 61 either directly or via a rechargeable battery pack 58. Power connection leads are identified as lines 62-67 and 92. The passageway 48 terminates in one or more jet nozzles 28, 29 which optionally may be selectively closeable by solenoid valves 68, 69. Upstream of diverter wedge 70 is a wash water bleed-off port 71 which communicates via passage 72 and solenoid 61 with wash water passages 73a, 73b which direct water across the radar unit ports 74a and 74b to wash them free of debris.

At the beginning of the horizontal hole jet undercutting operation, solenoid valve 59 is open and solenoid valves 60 and 61 are closed. The jet water (solution) travels down the pipe passage 48 and enters the jet/power/monitoring tool 27 at a preselected pressure to rotate the hydro-electric turbine 50 to provide power for the solenoid valves 59-61, 68 and 69, modified MWD package 57, radar (EMR) unit 21, and the rechargeable battery pack 58.

The water (solution) then travels to and emerges out of the jets 28, 29 and impinges on the evaporite mineral to erode and dissolve the same; however splashing and recrystallization can occur on the radar ports and interfere with measurements. Solenoid valve 61 is time sequenced to provide needed flushing water to clear the ports 74a and 74b via bleed-off port 71 and wash water passages 72 and 73a, 73b.

The radar unit or other EMR devices 21 measures the lateral distance of the undercut and the time involved to cut that distance. When the desired undercut width is effected, the tool is retracted up hole to start another undercut slice. The tool can be left stationary in its new position or slowly moved back and forth a short predetermined distance. As experience is acquired in a particular evaporite deposit, the EMR unit should not be required at all times. At certain standard operational procedures using pre-determined pressures, times, and water (solution) temperatures, a normal routine can be perfected for undercutting, with occasional progress measurements by the EMR (radar) unit.

If there is an inordinate amount of interference due to the jet splashing on the evaporite surface which in turn hinders EMR measurements, then solenoid valve 59 is closed and solenoid valve 60 is opened which discharges the water (solution) out the horizontal underside of the tool. Enough flow is allowed to turn the hydroelectric turbine to provide sufficient power to the radar unit 21 for undercut distance measurements and to power the MWD 57 for pressure wave transmissions through the water (solution) up-hole to a receiver/analyzer on the surfaces (not shown). Likewise commands can be transmitted to the tool for operational changes.

If the water (solution) discharge via solenoid valve 60 still causes too much splashing and interference, both solenoid valves 59 and 60 are closed. The rechargeable battery pack 58 will supply the power as a back-up power source for necessary measurements and data transmissions, after which operation as described above recommences.

The MDW package 57 transmits the undercut width and the orientation of the jets/tool with respect to the horizontal plane. The tool orientation can be changed and controlled from the surface in the conventionally known manner for navigation drilling tools.

FIGS. 11–13 illustrate advantages of the in-air jetting undercut plus solution mining system of this invention. To develop an undercut from and along a horizontal lateral drill hole would be an extremely complicated and difficult operation if the oil/air pad/circulating solution undercut system of the prior art is utilized in holes several hundred feet or more in length. It would be virtually impossible to maintain a constant undercut width for the length of a horizontal hole. FIGS. 11*a* and 11*b* show necking-down 75 or the barbell shape of the solution cavity 31 along the length of the undercut. The solution cavity of the prior art is shown by outline 37, while the outline of the cavity of this invention is shown by outline 26. The difference between the cavities, lost reserves 36, is highlighted by crosshatching.

As described above, open-air jet undercutting is especially amenable to maintaining an essentially constant width undercut for a dipping deposit. Once an undercut is formed by the open-air jet system of this invention and monitored production solution mining occurs in a relatively pure deposit, the resulting walls of the cavity 8, 9 are more nearly vertical being steeply angled outward at 10° to 15° from the vertical plane normal to the edge of the undercut (see FIG. 13*b*). In contrast, FIGS. 11*b* and 12*b* show the relative loss of reserves 36 by the prior art oil/air pad/circulating solution method (outline 37) as compared to the open-air system of this invention (outline 26). For example, where the in-air jet undercut of the invention is the correct width for a stable roof support, and the outline 26 is superimposed on the barbell shaped outline 37 of the prior art methods, the loss of mining reserves 36 is clear.

FIG. 12*b* shows that oil/air pad/solution undercuts of the prior art result in oversized roof spans which are unstable and result in roof collapse when the undercut is not correctly monitored and controlled. The stable roof span 33 resulting from an in-air jet undercut plus solution mining of the invention is superimposed in FIG. 12*b*. The stable roof span 33 is compared to the unstable span 34. The stable pillar width 35*a* formed between adjacent cavities is compared to the unstable width 35*b*.

In bedded deposits where the beds are relatively thin, i.e. 5 ft. to 50 ft., and where the beds are solution mined by the prior art from a single lateral hole (horizontal or dipping) without undercutting there is loss of evaporite reserves and unstable roof/pillar configurations as shown in FIG. 13*a*. Also in the long axis, the cavity will develop in a barbell configuration.

The angle of dissolution is basically determined by the insolubles dropping out as a coating 4 on the dissolution surface and the variation of brine salinity along the dissolution surface. If the mining is not stopped when the prior art 45° sloping cavity wall 77 intersects the roof rock 3, then dissolution will proceed laterally, 38, and increase the roof span. This results in an unstable roof 17 and pillar 18.

By using an undercut, the dissolution rate is increased. For example, according to test results by A. Saberian, at 23° C. and a water salinity of 3 moles per liter, the rate of halite removal from a −90° (horizontal) undercut (FIG. 13*b*) is increased by 106% as compared to a dissolution slope of +45° (FIG. 13*a*).

Figure 13B:
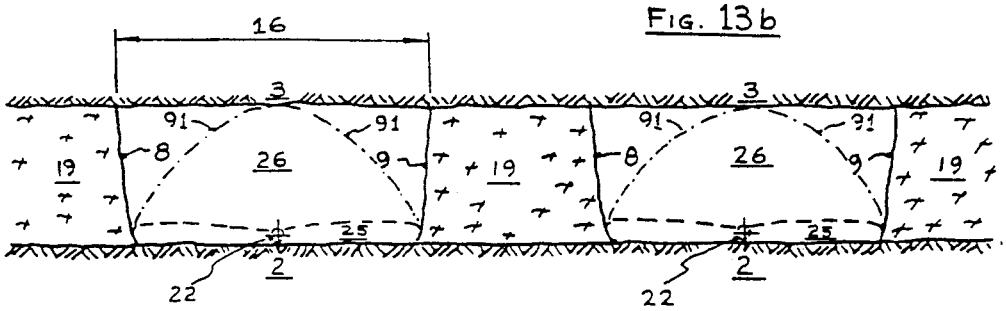

FIG. 13*b* shows in cross section mining cavity formation 26 in accord with this invention. That cavity shape 26 is superimposed on the morning glory shape 30 in FIG. 13*a*. It shows loss of reserves 76 (crosshatched), and the unwanted dissolution volume 38 which results in unstable roof span 17 (as compared to the stable roof span 16). It also shows the unstable pillar (18 in FIG. 13*a* and 35*b* in FIG. 12*b*), compared to the stable pillar (19 FIG. 13*b* and 35*a* in FIG. 12*b*) formed by the in-air jet/dissolution mining technique of this invention. Phantom outline 91 in FIG. 13*b* shows an initial stage of cavity development which then expands to steep cavity walls 8 and 9. However, the cavity development should be monitored, e.g., by sonar mapping, to stop further solution mining from expanding the cavity beyond walls 8 and 9. Additional control of cavity configuration can be achieved by using an inert blanket on top of the solution in the cavity and by mass flow measurements.

When the length of the cavity exceeds the undercut width by a range of 4 to 6, then other methods can be utilized to effect essentially rectilinear shaped cavity walls with a minimum of barbell shape development.

Figure 14C:
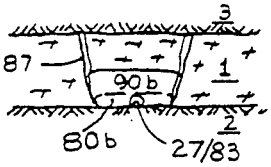

FIG. 14*a*, 14*b*, and 14*c* show a staged undercut/-cavity solution mining operation in accord with this invention. The staged cavity as shown in outline 87 is comprised of a series of individually developed undercuts 80*a–h* and cavities 90*a–h*. Starting from well 10, the first open-air jet undercut stage 80*a* is made and the first cavity stage 90*a* is solution mined. The barren solution can be injected to undercut 80*a* by string 22 to the jet mechanism 27 via solenoid value 60. Optionally jet mechanism 27 can be removed and string 22 can be open ended or a singe forward facing jet nozzle can be installed at the end of the string. Solution mining commences by pneumatically pressurizing annuli 41*a* and 41*b* in wells 20 and 20 respectively (refer to FIGS. 8*a* and 8*b*), thereby establishing air cushions so the solution is allowed to rise in the annuli 50 ft. to 100 ft. above the bed roof. The saturated solution is lifted to surface by submersible pump 14 via string 81 with a minimum of power, due to the system being in hydrostatic balance except for head losses in string 81 due primarily to increased viscosity and the greater weight of the saturated solution column.

Where air jet pump or pressurized gas lift means 14 is used in string 81, the solution flow is simplified by installing a well 20 surface pump (not shown) that is connected to string 22 to inject the barren solution with sufficient pressure to over come the head losses in string 81 while the air cushion is still maintained in the annuli 41*a* and 41*b*.

After solution mining is completed in cavity stage 90*a*, the solution is removed and open-air jetting commences to develop undercut stage 80*b*. The solution mining operation is repeated to form cavity stage 90*b*. FIG. 14*a* shows the cavity 90*b* in the process of solution mining. This operation is repeated until the entire staged cavity 87*a–h* is completely mined. The length of a cavity stage should be 2 to 3 times the width of the undercut stage.

The amount of initial dissolution can be varied for the cavity stages. For example, initial percentage dissolution completions can be for cavities 90*a* and 90*h* at 40%, 90*b* and 90*g* at 60%, 90*c* and 90*f* at 80%, and 90*d* and 90*e* at 90% (more in the longitudinal center, less at the ends). This technique, serves two purposes. If the deposit contains a substantial amount of insolubles, the insolubles accumulation on the undercut floor is reduced initially, thereby reducing blockage of subsequently produced jet fluids and fines to well 10. Depending on the dip of the deposit, there can be sufficient cavity space above the insolubles to allow up-dip undercutting fluids and fines to override (flow over) these accumulations. In the final solution mining operation, wells 20 and 10 would be alternated as injection and production wells. Due to the gradation of the initial dissolution from each well, the final solution mining operation will result in a cavity with minimal barbell shape development.

FIGS. 15*a* and 15*b* show another method for developing an essentially long uniform shaped cavity. An open-air undercut 25 is made from well 10 and advanced up-dip to well 20. A vertical mid-cavity well 78 intersects bed 1 and undercut 25 at the mid-point of the cavity's longitudinal axis. A solution mining string 79 is installed in well 78 and is operated without or with diametrically positioned jet nozzles 84, shown in FIG. 15*c*. If desired, string 22 is removed from well 20 and the side jet mechanism can be replaced with a forward (longitudinally) facing jet nozzle 83 or be left open-ended. String 81 in well 10 can be installed as open-ended or installed with a single jet nozzle 85 positioned parallel to the undercut floor and directed to string 79.

Where all jet nozzles are used for barren solution injection, the annuli 41*a*, 41*b*, and 86 are used for production return flows of saturated solution. Occasionally these annuli are flushed with barren solution to dissolve the build-up of crystals on the annuli surfaces. Where jet nozzles are not used, then the operation as described for the staged cavity 87 system can be implement. Also a combination of the two operations can be utilized. Various injection/production permutations can be employed. For example, well 78 can be the injection unit, while well 10 and 20 serve as production units. This scenario also can be reversed, or other variations applied.

The undercut jetting pressure can be varied in any desired sequence. For example, the jet pressure (in psi) can be held relatively constant over time and then reduced rapidly as the jet reaches the desired lateral extent (as measured, or time cut). In this example, the lateral extent (on either side of the horizontal string) is 30', the pressure can be held high until the lateral cut reaches 22–23' and then dropped rapidly until the cut is the full 30' as determined by the measuring means (e.g., radar). Of course the pressure must be kept sufficient for the jet to reach the full 30' (the reach pressure). An alternate mode is to have the pressure drop in a smooth decaying curve to the reach pressure over time until the full cut width is obtained. Then the string is withdrawn incrementally, or in an oscillatory manner, or continuously, and another cut mode.

Eroded solids from the undercut will range from large to very fine particles. These will settle on the dip slope. A very fine suspension of particles occurs in the sump and these can be dissolved with hot water in the sump so as to prevent crystallization in the return line 81 (see FIG. 8*b*).

As noted above, the horizontal hole is preferred to go down dip to aid in flow to the sump during undercutting. However, the hole can be directed across the strike, even in a steeply dipping bed. In a completely horizontal bed (rare), the horizontal hole should dip from 1°–5° starting in the bed sufficiently above the floor so that adjacent the sump the floor is reached by the inclined horizontal string.

While jetting is preferred transverse to the axis of the horizontal string, the jets can be angled forward, up to about 45°–60° forward of normal to the horizontal string axis, to assist in flushing fines to the sump (see FIG. 4). By this angling method the string tends to be "aggressive," i.e. it advances into the undercut face (the direction of withdrawal) by the back pressure of jet on the mineral face being eroded. Likewise, as shown in FIG. 4, jetting may occur only on one side, e.g. at a claim/lease boundary where jetting would occur toward the claim/lease center, or where the horizontal string deviated direction and came too close to a previous cavern or a hanging wall or footing. Flaring on the side opposite the jets needs to be monitored.

Radar measurement is preferred as spray can interfere with laser and IR beams. Thus the jets should be turned off during ranging with laser and IR techniques.

It should be understood that various modifications within the scope of this invention can be made by one of ordinary skill in the art without departing from the spirit thereof. For example, the undercut/solution mining process of this invention can also be applied to vertical single well (bore hole) operations, by use of a concentric pipe drill string wherein the inner pipe (or outer annulus) delivers jetting fluid (solution plus gas) down to string-mounted inclined rotating jets, and the outer annulus (or inner pipe) reaches down to a lower, reamed sump wherein back-flowing pregnant solution and fines are pumped out. Once the undercut is completed, the controlled solution mining step can be carried out in a manner to prevent morning glory cavities. I therefore wish my invention to be defined as broadly as the prior art will permit in view of the specification.

I claim:

1. A method of mining evaporite minerals comprising in operative combination the steps of:

a) developing a first, production well into an evaporite mineral formation, which well includes a sump for withdrawal of evaporite mineral in solution and evaporite mineral fines;

b) developing a second, horizontal well into said formation, said horizontal well comprising a drill bore having an axis, which bore is in communication with said production well;

c) providing an aqueous cutting solution to said horizontal well;

d) undercutting said formation with at least one in-air jet of said cutting solution to form an undercut cavity having a wide, vertically thin profile viewed in elevation along the axis of the horizontal well bore;

e) collecting evaporite mineral and fines solution and pumping at least a portion thereof out of said formation at a sufficient rate to prevent filling of the undercut with solution to maintain said jetting in air;

f) progressively withdrawing said undercut axially in said horizontal well away from said production well to progressively undercut said formation laterally with respect to the axis of said horizontal well bore; and g) solution mining evaporite mineral above said undercut to form a cavity from removed evaporite mineral.

2. An evaporite mineral mining method as in claim 1 which includes the step of:

a) monitoring the width of said undercut cavity by EMR ranging; and b) controlling said jet undercutting to provide a predetermined undercut cavity width.

3. An evaporite mineral mining method as in claim 2 wherein:

a) said formation is bedded, said bed angle ranging from about 0° to about 90° to the horizontal;

b) said production well is substantially vertical;

c) said horizontal well is developed in a down dip inclination ranging from about 0° to about 5° below the horizontal, and said progressive undercut proceeds up dip; and d) each of said jets is disposed inclined from about 0° to about 15° above the horizontal and angled from about 0° to about 60° forward of normal to the horizontal axis of said horizontal well.

4. An evaporite mineral mining method as in claim 3 wherein:

a) said solution mining includes controlling said solution mining to provide substantially vertical upright mineral removal cavity walls without flaring upwardly to a defined roof.

5. An evaporite mineral method as in claim 4 wherein:

a) said EMR monitoring includes radar ranging of the progress of said undercut; and which method includes:

b) transmitting ranging information to the surface.

6. An evaporite mineral mining method as in claim 5 wherein a portion of said jetting fluid is employed to wash radar ports to keep them clean.

7. An evaporite mineral method as in claim 3 wherein said formation steeply dips, and said horizontal hole is developed across the strike of said formation.

8. An evaporite mineral method as in claim 3 wherein said jetting occurs along only one side of said horizontal well.

9. An evaporite mineral mining method as in claim 3 wherein said step of controlling the lateral extent of said undercutting includes:

a) monitoring and control of at least one of solution temperature, rate and amount of undercutting solution flow out the jets, jet pressure, sump pump out rate, jet inclination, jet angle, horizontal well withdrawal rate, and mineral concentration of jetting solution in relation to the nature and type of mineral deposit.

10. An evaporite mineral mining method as in claim 3 wherein:

a) said mineral is a saline mineral.

11. An evaporite mineral mining method as in claim 10 wherein:

a) said saline mineral is selected from the group consisting essentially of nahcolite, trona, natron, sylvite, halite, borax, nitrate, and mirabilite.

12. An evaporite mineral method as in claim 2 wherein jetting pressure of said aqueous cutting solution is reduced as said undercut approaches a predetermined desired undercut cavity width.

13. An evaporite mineral mining method as in claim 1 which includes the steps of:

a) developing a longitudinal cavity by alternate stages of undercutting followed by solution mining; and b) each of said stages being substantially less than the full length of said final cavity but longitudinally greater in length than the width of said undercut; and c) repeating said alternate stages.

14. An evaporite mineral mining method as in claim 13 wherein:

a) each said stage has a longitudinal length in the range of up to about 4 to 6 times the width of the cavity; and b) said stages adjacent at least one of said wells are solution mined less than at the approximate midpoint between said wells.

15. An evaporite mineral mining method as in claim 1 which includes the step of:

a) developing an additional well intermediate said first and second wells, said wells being operated as production and/or solution inlet wells.

16. A jet undercutting tool for in-air jet undercutting of evaporite minerals comprising in operative combination:

a) a cylindrical housing having a first, tip end and an axially spaced inlet end, said inlet end being adapted to be coupled to a horizontal well pipe string supplying a liquid undercutting solution to said tool;

b) at least one non-axially rotatable jet assembly disposed substantially along the mid-line of said jetting tool including a nozzle for directing high pressure fluid against evaporite mineral formation at an angle in the range of from about 90° transverse to the axis of said tool to about 60° forward of transverse the axis of said tool, and being inclinable up from the horizontal in the range of from about 0° to about 15°, said jets being disposed medial of said tip and said inlet end;

c) at least one jet fluid conduit disposed in said housing for communicating solution from said horizontal well string to said jet assembly;

d) means for ranging by electromagnetic radiation (EMR) the depth of undercutting;

e) means for providing power to said EMR ranging unit disposed in said tool; and f) means for selectively controlling flow of cutting fluid to said jets.

17. Jetting tool as in claim 16 wherein:

a) said means for providing power to said ranging unit is a fluid turbine disposed axially of said tool powered by fluid flowing through said conduit.

18. Jetting tool as in claim 17 wherein:

a) said EMR unit is a radar unit.

19. A jetting tool as in claim 14 which includes:

a) an MWD unit or dot line for transmitting tool orientation information and ranging information from said EMR unit to the surface and for receiving control commands from the surface.

20. A jetting tool as in claim 19 which includes:

a) jetting fluid bypass conduits disposed to provide sufficient jetting fluid to wash obscuring evaporite deposits collecting on said radar unit; and b) said bypass conduits including means for controlling the flow of fluid therethrough to selectively wash said radar unit.

21. A jet undercutting tool as in claim 16 which includes:

a) at least one additional jet assembly for directing high pressure fluid against a mineral formation at an angle of from about 30° to 90° up from the horizontal.

* * * * *